United States Patent [19]

Hashimoto

[11] Patent Number: 4,612,674

[45] Date of Patent: Sep. 23, 1986

[54] UNDERWEAR AND METHOD OF MAKING SAME

[75] Inventor: Kenji Hashimoto, Nishinomiya, Japan

[73] Assignee: Yabumoto Kenji, Amagasaki, Japan; a part interest

[21] Appl. No.: 774,180

[22] Filed: Sep. 9, 1985

Related U.S. Application Data

[63] Continuation of Ser. No. 651,363, Sep. 17, 1984, abandoned, which is a continuation of Ser. No. 280,004, Jun. 30, 1981, abandoned.

[30] Foreign Application Priority Data

Oct. 31, 1979 [JP] Japan ..... 54-150958[U]

[51] Int. Cl.[4] ..... A41B 9/04

[52] U.S. Cl. ..... 2/406; 2/243 R

[58] Field of Search ..... 2/406, 407, 403, 404, 2/409, 243 R, 400, 402

[56] References Cited

U.S. PATENT DOCUMENTS 3,016,900 1/1962 Title ..... 2/406

3,344,438 10/1967 Title ..... 2/406

FOREIGN PATENT DOCUMENTS 127492 7/1975 Japan ..... 2/406

104414 9/1977 Japan ..... 2/406

779595 7/1957 United Kingdom ..... 2/406

*Primary Examiner*—H. Hampton Hunter

*Attorney, Agent, or Firm*—Armstrong, Nikaido, Marmelstein & Kubovcik

[57] ABSTRACT

Panties, briefs or like underwear includes a front piece 2 for covering lower abdomen, a rear piece 3 for covering buttocks and a connector piece 4 interconnecting the front piece 2 and the rear piece 3 for covering the crotch. The rear piece 3 is stitched at its lower end to the connector piece 4 while being stretched most greatly on the center line of the rear piece 3 and to a progressively lesser extent from the center line toward the opposite sides thereof. As a result, an elongated depression 6 extending vertically is formed on the center line of the rear piece 3 in conformity with the gluteal cleft between the buttocks. On the opposite sides of the depression 6, the rear piece 3 has rounded portions in conformity with the bulges of the buttocks.

5 Claims, 5 Drawing Figures

UNDERWEAR AND METHOD OF MAKING SAME

This application is a continuation of application Ser. No. 651,363 filed Sept. 17, 1984 now abandoned which in turn is a continuation of Ser. No. 280,004 filed June 30, 1981.

TECHNICAL FIELD

This invention relates to underwear, such as panties and briefs, and to a method of making the same.

BACKGROUND ART

Panties, briefs and like undergarments heretofore known have the drawback that when they are worn, the portion of the undergarment covering the buttocks extends merely in a planar fashion over the gluteal cleft between the buttocks and hangs loosely at its lower part to form wrinkles, thus failing to present attractive hip lines. Conventional undergarments further have the drawback of being uncomfortable to wear since the garment is unable to fit over the buttocks and the gluteal cleft in intimate contact therewith for enclosing and supporting these body portions.

The present invention, which has overcome the foregoing drawbacks, provides panties, briefs and like undergarments which are comfortable to wear and capable of presenting attractive hip lines, and a method of making such underwear.

DISCLOSURE OF INVENTION

Throughout the description, the term "upper" or "upward" and "lower" or "downward" are used with reference to FIGS. 1 and 2.

The underwear of this invention comprises a front piece for covering the lower abdomen, a rear piece for covering the buttocks, and a connector piece interconnecting the front piece and the rear piece for covering the crotch. The front piece and the rear piece are stitched together each at its upper opposite side portions. The connector piece is stitched at its one end to the lower end of the front piece. The other end of the connector piece and the lower end of the rear piece define a space therebetween when placed in butting relation to each other. The space is shaped symmetrically with respect to the center line thereof and has a progressively increasing width toward the center line. The rear piece is stitched at its lower end to the other end of the connector piece while being stretched most greatly on the center line of the rear piece.

The underwear therefore has an elongated depression extending on the center line of the rear piece and conforming to the gluteal cleft between the buttocks. On the opposite sides of the depression, the rear piece has rounded portions in conformity with the bulges of the buttocks. Accordingly the underwear of this invention, when worn, snugly fits to the curves of the buttocks and the gluteal cleft, assuming graceful hip lines. Because the rear piece covers and supports the buttocks in intimate contact therewith, the underwear feel smooth and comfortable.

The method of making underwear of this invention comprises stitching together, at suitable portions, a front piece for covering the lower abdomen, a rear piece for covering the buttocks and a connector piece for covering the crotch. The method is characterized in that the rear piece and the connector piece are stitched together at their adjoining portions while the rear piece is stretched toward the connector piece to the greatest extent along the center line of the rear piece and to a progressively lesser extent from the center line toward the opposite sides thereof, whereby an elongated depression is formed on the center line of the rear piece with a bulged portion also formed on each side thereof.

Accordingly underwear comfortable to wear and presenting graceful hip lines can be fabricated with extreme ease without necessitating any special procedure or material for cutting the fabric or for sewing.

The underwear of this invention is made preferably from stretchable knitted fabrics. With the method of this invention, the front piece, the rear piece and the connector piece may be cut out from a fabric separately. Alternatively the rear piece and the connector piece may be cut out as an integral piece.

The present invention is useful not only for panties and briefs but also for corsets, girdles, etc. for covering the lower trunk of the human body. The invention is similarly useful for the lower trunk portions of leotards, bathing suits, sportswear, foundation garments such as all-in-ones, etc. for covering both the upper and lower trunks of the body.

BRIEF DESCRIPTION OF THE DRAWINGS

FIG. 1 is a rear view showing panties worn on the human body;

FIG. 2 is a side elevation of the same;

FIG. 3 is a view in section taken along the line III—III in FIG. 1;

FIG. 4 is a plan view showing cut out front piece, rear piece and connector piece.

BEST MODE OF CARRYING OUT THE INVENTION

Figure 1:
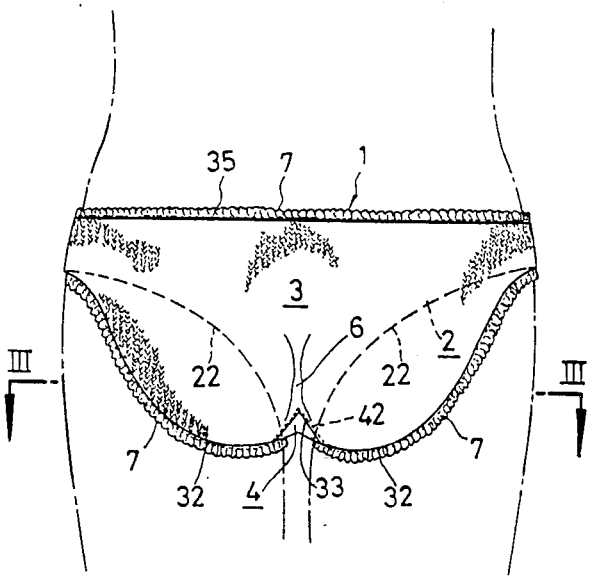
FIGS. 1 to 4 illustrate a preferred embodiment of this invention.
Figure 2:
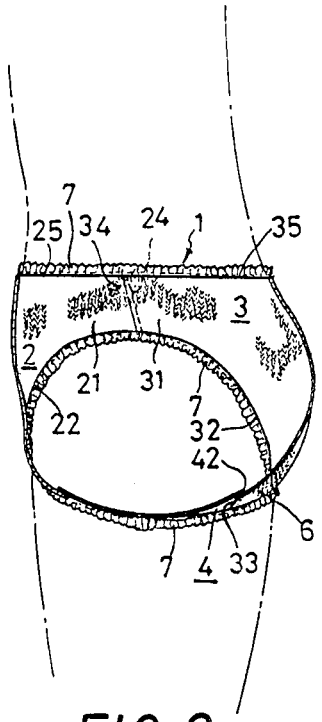
Figure 3:
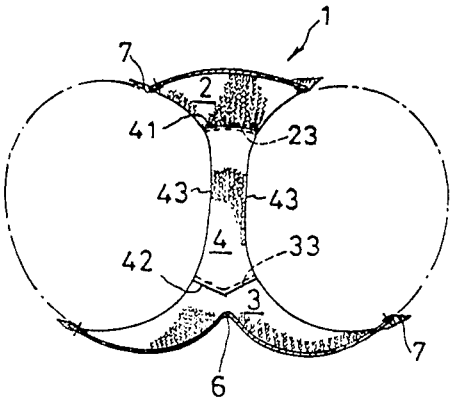

With reference to the drawings, the invention will be described in detail below.

Panties, briefs or like underwear 1 comprises a front piece 2 for covering the lower abdomen, a rear piece 3 mainly for covering the buttocks, and a connector piece 4 interconnecting the front piece 2 and the rear piece 3 for covering the crotch. Most preferably these pieces 2 to 4 are prepared from a stretchable knitted fabric. However, other knitted fabrics, woven fabrics or non-woven fabrics are also usable.

The front piece 2 has projections 21 at its upper opposite side portions. The front piece 2 has a width progressively decreasing downward, and opposite side edges 22 each curved in conformity with the groin between the thigh and the abdormen or with a part slightly above the groin. The lower end 23 of the front piece 2 and one end 41 of the connector piece 4 are curved to conform with each other and stitched together.

The rear piece 3 also has projections 31 extending outward from its upper opposite side portions obliquely upward. The projections 31 are bent toward the front piece 2 and stitched at their ends 34 to the opposed ends 24 of the projections 21, whereby a portion is formed for covering the waist. The rear piece 3 has edges 32 extending from its lower portion toward the side projections and conforming to the curves of the buttocks. The area and shape of the portion of the rear piece 3 surrounded by the edges 32 are determined in accordance with the bulging degree and contours of the buttocks.

Figure 4:
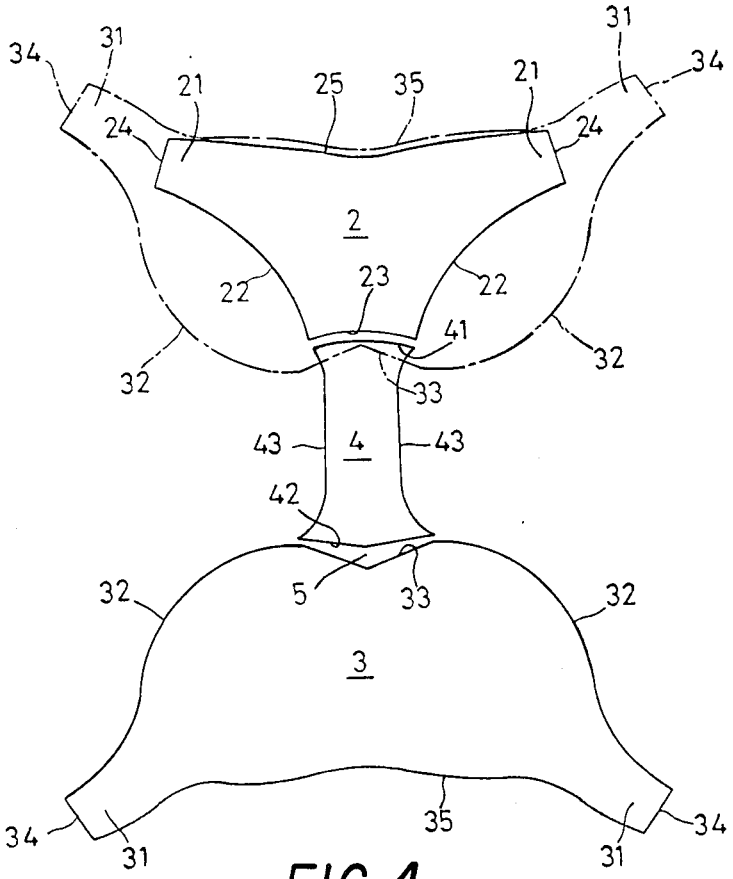

The other end 42 of the connector piece 4 is defined by two edges slanting outward toward its longitudinal center line. The central lower end 33 of the rear piece 3 to be stitched to the end 42 is defined by two edges slanting upward toward its center line. These ends 33 and 42 differ in the angle of inclination, such that the ends 33 and 42 define a space 5 therebetween when placed in butting relation to each other before the rear piece 3 and the connector piece 4 are stitched together, as seen in FIG. 4. The space 5 has a progressively increasing width toward the center line thereof.

The rear piece 3 and the connector piece 4 are stitched together at the opposed ends 33 and 42 while the lower end portion 33 is being stretched toward the connector piece 4 to the greatest extent along the center line of the rear piece 3 and to a progressively lesser extent from the center line toward the opposite sides thereof. Since the rear piece 3 is thus stretched to the greatest extent on its center line, the underwear 1 formed has an elongated depression 6 extending vertically on the center line of the rear piece 3 and conforming to the gluteal cleft between the buttocks. On the opposite sides of the depression 6, the rear piece 3 has rounded portions in conformity with the bulges of the buttocks. Consequently the rear piece 3 of the underwear 1 covers and supports the buttocks in intimate contact therewith, feels smooth and comfortable, and fits snugly to the curves of the buttocks and gluteal cleft, giving a graceful appearance.

Figure 5:
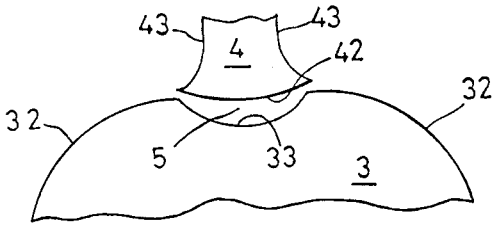
FIG. 5 is a fragmentary plan view showing cut out rear piece and connector piece according to another embodiment of the invention.

The lower end 33 of the rear piece 3 and the end 42 of the connector piece 4 to be stitched thereto may be arcuated as shown in FIG. 5. In this case, the space 5 formed between the ends 33 and 42 also has an increasing width toward its center and resembles a crescent in shape. Alternatively the depression 6 can be formed in an integral seamless piece of fabric including the rear piece 3 and the connector piece 4, by drawing the integral piece into a fold at the portion thereof corresponding to the junction of the abovementioned ends 33 and 42 so that the rear piece portion of the integral piece will be stretched to the greatest extent on its center line, and fixing the folded portion suitably by stitching. In this case, the front piece 2 may be integral with or separate from the connector piece 4.

When desired, a stretchable and decorative tape 7 may be stitched to the upper edges 25, 35 of the front and rear pieces 2, 3 to be fitted around the waist, and also to the side edges 22, 32, 43 of the front and rear pieces 2,3 and the connector piece 4 to be fitted around the legs. The tape 7 is made partially or entirely from stretchable yarns, such as rubber yarns or spandex yarns, by knitting or weaving.

INDUSTRIAL APPLICABILITY

The underwear is one of the daily necessaries. Most of the undergarments are made by underwear makers. The underwear and the method of making same of this invention can be put into practice by the industry of underwear making and contribute to the developments of this industry.

I claim:

1. Underwear comprising a front piece for covering the lower abdomen, a rear piece for totally covering the buttocks and a connector piece interconnecting the front piece and the rear piece for covering the crotch, the front piece and the rear piece, each being symmetrically shaped about respective center lines and each having upper side portions and lower ends, and being stitched together at their opposing upper side portions, the connector piece also being symmetrically shaped about a centerline and having a first end and a second end and being stitched at its first end to the lower end of the front piece, with their respective centerlines aligned and with the lower end of the front piece and the first end of the connector piece being curved so as to conform with each other, the second end of the connector piece and the lower end of the rear piece being shaped such that, when placed with respective lateral edges thereof in abutting relation with each other and with their respective centerlines aligned, there is defined therebetween a space shaped symmetrically with respect to the center line of alignment and of the space and having a progressively increasing width toward the center line from the abutting lateral edges, the rear piece being stitched at its lower end to the second end of the connector piece while being stretched to the greatest extent on the center line of symmetry of the rear piece so that the underwear has an elongated depression extending inwardly toward the wearer on the centerline of the rear piece and conforming to the gluteal cleft between the buttocks and so that the rear piece has round portions extending outwardly in conformity with the bulges of the buttocks on the opposite sides of the depression, the juncture of the rear piece and the connector piece being at the lowermost portion between the left and right buttocks when the underwear is worn.

2. Underwear as in claim 1 wherein the second end of the connector piece is defined by two edges slanting outwardly toward its center line of symmetry from its lateral edges, and the lower end of the rear piece is defined by two edges slanting inwardly toward its center line of symmetry from its lateral edges.

3. Underwear as defined in claim 1 wherein the other end of the connector piece and the lower end of the rear piece are arcuated.

4. Underwear as defined in any one of claims 1 to 3 which is made of a knitted fabric.

5. A method of making underwear by joining together a front piece for covering the lower abdomen, a rear piece for covering the buttocks and a connector piece for covering the crotch, the method comprising cutting out the front piece, the rear piece and the connector piece from a fabric material, the front piece and the rear piece each being symmetrically shaped about respective center lines and each having upper side portions and lower ends and the connector piece also being symetrically shaped about a center line and having a first end and a second end, stitching together the corresponding upper side portions of the front and rear pieces, stitching together the lower end of the front piece and the first end of the connector piece, and stitching the lower end of the rear piece and the second end of the connector piece together at adjoining portions thereof with their respective center lines of symmetry aligned while stretching the rear piece toward the connector piece to the greatest extent along the center line of symmetry of the rear piece and to a progressively lesser extent in the portions further away from the center line toward the opposite sides thereof to form an elongated depression extending inwardly toward the wearer on the center line of the rear piece and a bulged portion on each side of the depression.

* * * * *